United States Patent [19]

Aoyama

[11] 4,152,892

[45] May 8, 1979

[54] SECONDARY AIR SUPPLY DEVICE FOR ENGINE EXHAUST SYSTEM

[75] Inventor: Syunichi Aoyama, Yokohama, Japan

[73] Assignee: Nissan Motor Company, Limited, Yokohama, Japan

[21] Appl. No.: 749,900

[22] Filed: Dec. 13, 1976

[30] Foreign Application Priority Data

Dec. 20, 1975 [JP] Japan ..... 50/151225

[51] Int. Cl.[2] ..... F02B 75/10; F01N 3/10

[52] U.S. Cl. ..... 60/290

[58] Field of Search ..... 60/289, 290

[56] References Cited

U.S. PATENT DOCUMENTS

| | | | |
|---|---|---|---|
| 3,696,618 | 10/1972 | Boyd | 60/276 |
| 3,826,089 | 6/1974 | Nakajima | 60/290 |
| 3,945,205 | 3/1976 | Atago | 60/289 |
| 3,973,535 | 8/1976 | Sugihara | 123/119 A |

*Primary Examiner*—Douglas Hart

[57] ABSTRACT

Secondary air fed to the exhaust system of an engine is controlled by controllably venting the secondary air passing through a secondary air supply conduit leading to the exhaust system using a diaphragm unit operated valve. Vacuum applied to the diaphragm unit is controlled by cooperation of the venturi vacuum and the pressure differential between two interior portions of the secondary air supply conduit to supply the exhaust system with an appropriate amount of secondary air to the exhaust gas amount.

18 Claims, 4 Drawing Figures

SECONDARY AIR SUPPLY DEVICE FOR ENGINE EXHAUST SYSTEM

This invention relates to a secondary air supply device for supplying air from a pressurized air source into the exhaust system of an internal combustion engine to oxidize the unburned constituents contained in the exhaust gases from the engine.

It is well known in the art that the unburned noxious constituents contained in the exhaust gases from internal combustion engines are effectively converted into harmless compounds by oxidation reactions carried out particularly in a reactor installed in the exhaust system of the engine in the presence of air (referred to as "secondary air") fed under pressure into the exhaust system. Recent automotive internal combustion engines equipped with complex noxious exhaust gas control systems require the feed of an appropriate amount of secondary air into the exhaust system of the engine because excess and deficiency of the secondary air amount invite failure of the effective operation of the exhaust gas control system. For example, in the internal combustion engine where a portion of the exhaust gases is fed into the combustion chamber of the engine for suppression of nitrogen oxides generation, supply of an inappropriate amount of secondary air into the exhaust system causes failure of an accurate control of the air-fuel ratio of the air-fuel mixture in the combustion chambers of the engine since the secondary air is supplied with the exhaust gases into the combustion chamber. This accurate control of the air-fuel ratio is required for effective noxious exhaust gas control from the engine.

It is, therefore, the prime object of the present invention to provide an improved secondary air supply device for the exhaust system of an internal combustion engine, which device can supply an appropriate amount of secondary air for the exhaust gases into the exhaust system thereby causing effective oxidation reactions of the unburned constituents contained in the exhaust gases within the exhaust system in the presence of the appropriate amount of secondary air.

Another object of the present invention is to provide an improved secondary air supply device for the exhaust system of an internal combustion engine, which device controls the secondary air amount fed into the exhaust system by cooperation of the venturi vacuum generated at the venturi portion of a carburetor and the pressure differential between two interior portions of a secondary air supply conduit leading to the exhaust system.

A further object of the present invention is to provide an improved secondary air supply device including a control valve assembly for controlling the amount of secondary air fed into the exhaust system of an internal combustion engine, which valve assembly is composed of a first pressure responsive diaphragm responsive to the venturi vacuum of a carburetor and a second pressure responsive diaphragm responsive to the pressure differential between two interior portions of a secondary air supply conduit leading to the exhaust system.

A still further object of the present invention is to provide an improved secondary air supply device for the exhaust system of an internal combustion engine, which device can decrease the amount of secondary air fed to the exhaust system regardless of the amount of the exhaust gases only during high engine speed and low engine load operation in which a smaller amount of the unburned constituents is contained in the exhaust gases.

Other objects, features and advantages of the present invention will become more apparent from the following description taken in conjunction with the accompanying drawings, in which.

Figure 1:
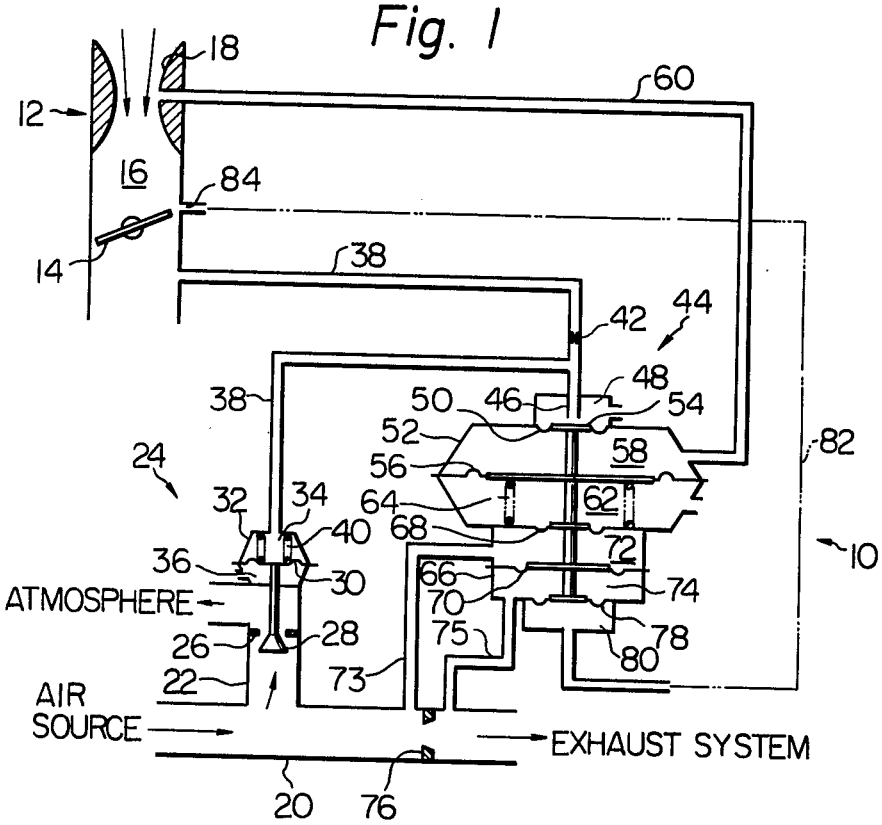
FIG. 1 is a schematical section view of a preferred embodiment of a secondary air supply device according to the present invention.

Referring now to FIG. 1 of the drawings, there is shown a preferred embodiment of a secondary air supply device according to the present invention, generally designated by the reference numeral 10, for supplying secondary air into the exhaust system of an internal combustion engine (not shown), in combination with a carburetor 12 which has a throttle valve 14 rotatably disposed within the air-fuel mixture induction passage 16 and a venturi portion 18 disposed upstream of the throttle valve 14.

The secondary air supply device 10 comprises a secondary air supply conduit 20 or passage connecting an air source such as an air pump and the exhaust system such as, for example, an exhaust manifold (not shown) of the engine in order to supply under pressure secondary air from the air source into the exhaust system. Branched off from the conduit 20 is a vent conduit or passage 22 which communicates with the atmosphere or may connect to an air filter (not shown) for cleaning the engine intake air to vent or discharge excess secondary air passing through the secondary air conduit 20 into the atmosphere.

The reference numeral 24 indicates a vacuum operated valve for controlling the opening of the secondary air passage formed inside of the vent conduit 22. The vacuum operated valve 24 is composed of a valve seat 26 formed inside of the vent conduit 22. Seatably disposed on the valve seat 26 is a valve head 28 fixedly connected to a diaphragm member 30 to open or close the valve 24 in response to the movements of the diaphragm member 30. The diaphragm member 30 divides a casing 32 into a vacuum chamber 34 and an atmospheric chamber 36 communicating with the atmosphere. The vacuum chamber 34 communicates through an intake manifold vacuum pipe 38 or a first pipe with a portion downstream of the throttle valve 14 to apply the intake manifold vacuum to the vacuum chamber 34. As shown, a spring 40 is disposed within the vacuum chamber 34 to urge the diaphragm member 30 in the direction to cause the valve 24 to open and is arranged to contract to allow the diaphragm member to move in the direction to cause the valve 24 to close. Reference numeral 42 indicates an orifice formed in the intake manifold vacuum pipe 38.

A control valve assembly 44 or control means comprises a second pipe 46 branched off from the intake manifold vacuum pipe 38 downstream of the orifice 42, the pipe 46 opening to a vacuum vent chamber 48. The vacuum vent chamber 48 communicates with the atmosphere and is defined by a casing (no numeral) and a first small diaphragm 50 which is secured to the top portion of a first casing 52. Secured to the first small diaphragm is a valve member 54 which is fixedly connected through a rod (no numeral) to a first pressure responsive diaphragm 56. The first pressure responsive diaphragm 56 is secured to the first casing 52 and divides casing 52 into a vacuum chamber 58 which communicates through a venturi vacuum pipe 60 or a third pipe with the venturi portion 18 of the carburetor 12 and into an atmospheric chamber 62 which communicates with the atmosphere. The valve member 54 is movably disposed adjacent the open end of the branched off pipe 46 and is arranged to open or close the open end thereof in response to the movement of the first pressure responsive diaphragm 56. As seen, a spring 64 is disposed within the atmospheric chamber 62 for urging the first pressure responsive diaphragm 56 in the direction to cause the valve member 54 to close the open end of the branched off pipe 46.

Disposed between the first casing 52 and a second casing 66 is a second small diaphragm 68 through which the first pressure responsive diaphragm 56 is fixedly connected by rods (no numerals) to a second pressure responsive diaphragm 70 secured to the second casing 66. The second pressure responsive diaphragm 70 divides casing 66 into a first pressure chamber 72 and a second pressure chamber 74. The first pressure chamber 72 communicates through a pipe 73 with the secondary air supply passage or an interior portion of the conduit 20 upstream of an orifice 76 formed inside of the passage 20 which orifice 76 is located downstream of a portion of the passage 20 from which the vent passage 22 branches off. The second pressure chamber 74 communicates through a pipe 75 with the secondary air supply passage or an interior portion of the conduit 20 downstream of the orifice 76. The second pressure responsive diaphragm 70 is normally forced to move downward on the drawing in response to the pressure differential upstream and downstream of the orifice 76.

A third pressure responsive diaphragm 78 is fixedly secured to the second pressure responsive diaphragm 70 and defines with a casing (no numeral) a vacuum chamber 80 which communicates through a pipe 82 with a hole 84 open to the air-fuel mixture induction passage 16 of the carburetor 12, the hole 84 being located above the edge of the throttle valve 14 when it is fully closed. It is to be noted that the second pressure responsive diaphragm 70 is smaller in effective area than the first pressure responsive diaphragm 56. The first and second small diaphragms 50, 68 and the third pressure responsive diaphragm 78 are considerably smaller in effective areas than the second pressure responsive diaphragm 70.

Figure 2:
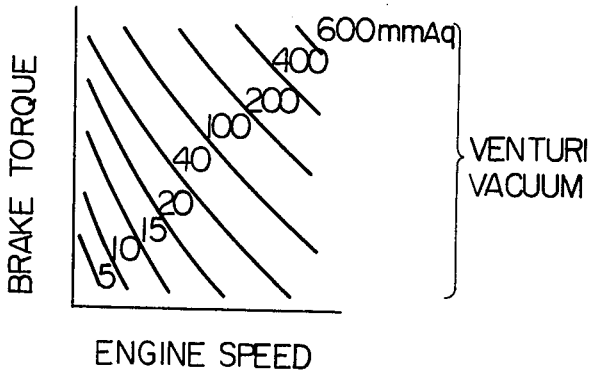
FIG. 2 is a graph showing the variation of the venturi vacuum generated at the venturi portion of a carburetor shown in FIG. 1, in terms of brake torque and venturi vacuum.

In operation, when an upward force (on the drawing) acting on the first pressure responsive diaphragm 56 due to the venturi vacuum from the venturi portion 18 of the carburetor and the spring force of the spring 64 are balanced with a downward force acting on the second pressure responsive diaphragm 70 due to the pressure differential between portions of the secondary air supply passage 20 upstream and downstream of the orifice 76 of the passage 20, the valve member 54 of the control valve assembly 44 is maintained at the position shown in FIG. 1. In this state, although the venturi vacuum and the pressure differential may be acting on the areas of the diaphragms 50, 68 and 78, their effects are small as compared with those acting on the areas of the diaphragms 56 and 70 and therefore are negligible. From this balanced state, as the engine speed or the output torque (brake torque) increases, the venturi vacuum generated at the venturi portion 18 of the carburetor 12 increases as shown in FIG. 2 and accordingly the first pressure responsive diaphragm 56 is moved upwardly (on the drawing) to cause the valve member 54 to close the open end of the branched off pipe 46. Then, the intake manifold vacuum is conducted through the pipe 38 into the vacuum chamber 34 of the vacuum operated valve 24 moving the diaphragm member 30 upward on the drawing. The valve head 28 is simultaneously moved upward on the drawing to throttle the air flow through pipe 22. Consequently, the secondary air amount vented through the vent passage 22 is decreased to increase the secondary air amount supplied to the exhaust system.

This increased secondary air supplied to the exhaust system increases the pressure differential between the upstream and downstream sides of the orifice 76 and then the pressure differential forces the second pressure responsive diaphragm 70 to move downward on the drawing. This downward movement of the second pressure responsive diaphragm 70 pulls the valve member 54 downward to open the open end of the pipe 46 branched off from the intake manifold vacuum pipe 38. Accordingly, the intake manifold vacuum applied to the vacuum chamber 34 of the vacuum operated valve 24 is decreased and consequently the valve head 28 is moved downward by the force of the spring 40 to increase the degree of opening of the valve 24. Therefore, the amount of the secondary air vented through the vent passage 22 is increased and the amount of the secondary air supplied to the exhaust system is accordingly decreased. By the effect of the decreased secondary air supplied to the exhaust system, the valve member 54 closes the open end of the branched off pipe 46. It will be understood that the amount of the secondary air supplied to the exhaust system of the engine is controlled as mentioned above in response to the venturi vacuum or the amount of the intake air. In other words, the secondary air supplied to the exhaust system is controlled in response to the amount of the exhaust gases discharged from the engine or the amounts of carbon monoxide (CO) and hydrocarbons (HC) contained in the exhaust gases since the amount of the exhaust gases is generally proportional to the amount of the intake air. As a result, oxidation reactions of CO and HC may be effectively accomplished in case where the engine is equipped with a reactor for oxidizing the unburned constituents contained in the exhaust gases discharged from the engine.

When the venturi vacuum is decreased with the decrease of the intake air passing through the venturi portion 18 of the carburetor 12, the valve member 54 is pulled downward to open the open end of the branched off pipe 46 and consequently the valve head 28 of the vacuum operated valve 24 is moved downward to open the the valve 24. Then, the secondary air vented through the vent passage 22 is increased to decrease the secondary air supplied to the exhaust system. In this state, when the pressure differential between the upstream and downstream sides of the orifice 76 decreases below a predetermined level, the valve member 54 is moved upward to close the open end of the branched off pipe 46. Thus, the secondary air supplied to the exhaust system is controlled in response to the venturi vacuum like in the case where the venturi vacuum increases.

During high load engine operation, the intake manifold vacuum downstream of the throttle valve 14 is decreased near atmospheric pressure and the valve 24 is opened to vent a large amount of the secondary air through the vent passage 22. Accordingly, a smaller amount of the secondary air is supplied to the exhaust system of the engine, which contributes to the prevention of thermal damage to the reactor installed in the exhaust system during the high load engine operation.

When the venturi vaccum is constant and the engine speed is increased, the air pump increases the amount of secondary air and consequently the secondary air supplied to the exhaust system will become excessive. However, the pressure differential between the upstream and downstream sides of the orifice 76, then, increases to pull the valve member 54 downward to thereby open the open end of the branched off pipe 46. This causes the valve 24 to open, by which the secondary air supplied to the exhaust system may be controlled in response to the venturi vacuum.

On the contrary, when the venturi vacuum is constant and the engine speed is decreased, the secondary air supplied to the exhaust system will become insufficient. However, the pressure differential between the upstream and downstream sides of the orifice 76 is decreased to allow the valve member 54 to move upward or in the direction of the open end of the branched off pipe 46 and to close the open end of the pipe 46. Therefore, the valve 24 is acting to decrease the amount of the secondary air vented through the vent passage 22 to increase the amount of the secondary air supplied to the exhaust system. As discussed above, the secondary air supplied to the exhaust system may be controlled in response to the venturi vacuum in any event.

Figure 3:
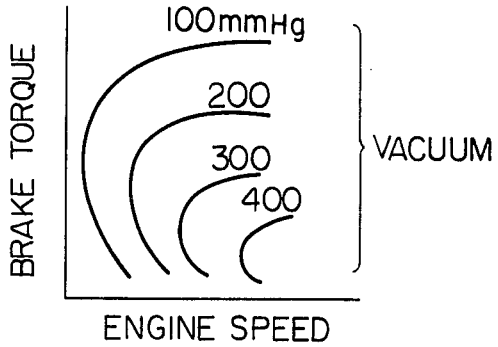
FIG. 3 is a graph showing the variation of the vacuum generated and sensed at a particular hole adjacent to the throttle valve of the carburetor in FIG. 1, in terms of brake torque and engine speed.

Now, during high engine speed and low engine load operation, i.e. a so-called vehicle coasting range, the vacuum generated adjacent the hole 84 open to the air-fuel mixture induction passage 16 of the carburetor 12 is introduced to the vacuum chamber 80 and acts on the third pressure responsive diaphragm 78. This vacuum forces the diaphragm 78 to move downward to pull the first pressure responsive diaphragm 56 downward against the upward force acting on the first pressure responsive diaphragm 56 due to the venturi vacuum. Accordingly, the valve member 54 allows atmospheric air to enter the pipe 46 causing the increase in the amount of the secondary air vented through the vent passage 22 to decrease the secondary air supplied to the exhaust system. In combination of the third pressure responsive diaphragm 78 and the vacuum adjacent hole 84 of the carburetor, the amount of the secondary air supplied to the exhaust system may be decreased regardless of the venturi vacuum. This control of the secondary air is desirable because the amounts of CO and HC contained in the exhaust gases are relatively small during the high engine speed and low load operation as compared with low engine speed and low load operation at which relatively large amounts of CO and HC are discharged with the exhaust gases. In this connection, the vacuum introduced through the hole 84 of the carburetor into the vacuum chamber 80 has the characteristics shown in FIG. 3, in which the vacuum increases as the engine speed increases and the brake torque or the engine load decreases.

Figure 4:
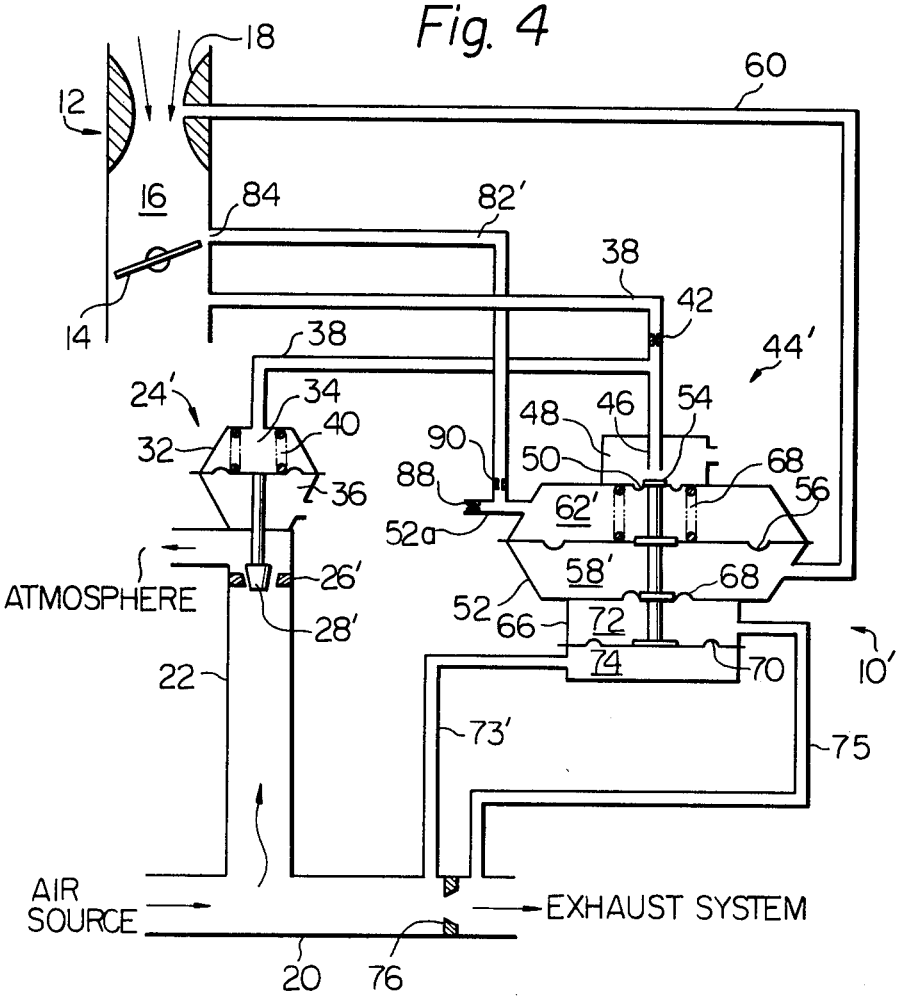
FIG. 4 is a schematical section view of another preferred embodiment of the secondary air supply device according to the present invention.

FIG. 4 illustrates another preferred embodiment of the secondary air supply device according to the present invention which is similar to the embodiment shown in FIG. 1, and consequently like reference numerals represent like parts and elements for the purpose of simplicity of illustration.

In this case, the vacuum operated valve 24' is arranged such that when the intake manifold vacuum is supplied to the vacuum chamber 34, the diaphragm member 30 is moved upward against the force of the spring 40 to increase the degree of opening of the valve 24'. In this case, the control valve assembly 10' is arranged as follows: the venturi vacuum is introduced through the pipe 60 into the vacuum chamber 58' formed by the first pressure responsive diaphragm 56, which is adjacent to the first pressure chamber 72, dividing casing 52 into chamber 58' and the atmospheric chamber 64' which communicates with the atmosphere through a pipe **52*a* formed with the first casing 52. As shown, the pipe 52*a* is equipped with an orifice 88. Connected to the pipe 52*a* is the pipe 82' which is connected to the hole 84 open to the air-fuel mixture induction passage 16 of the carburetor 12. As seen, the pipe 82' has an orifice 90 adjacent to the pipe 52*a*. It will be understood that the vacuum through the hole 84 can be introduced into the atmospheric chamber 62' after being decreased and therefore application of an excessive vacuum to the first pressure responsive diaphragm 56** is effectively prevented during the high engine speed and low engine load operation.

It is seen from the foregoing description that the secondary air supply device shown in FIG. 4 operates in a similar manner to that shown in FIG. 1, and the third pressure responsive diaphragm 78 used in the embodiment of FIG. 1 can be deleted.

While only the orifice 76 has been shown and described for the purpose of generating the pressure differential throughout the embodiments of FIGS. 1 and 4, other means for generating the pressure differential may be used in place of the orifice 76. Furthermore, it will be understood that no particular means for generating the pressure differential may be used within the secondary air supply passage 20 since the pressure differential is as a matter of course generated between the two portions of the passage 20 when the secondary air flows through the passage 20.

As is apparent from the foregoing discussion that, according to the present invention, an appropriate amount of secondary air for the amount of the exhaust gases can be supplied to the exhaust system of the engine by the cooperation of the venturi vacuum and the pressure differential between the upstream and downstream portions of the secondary air supply conduit leading to the exhaust system. Therefore, the oxidation reaction of the unburned constituents contained in the exhaust gases is effectively accomplished within the reactor installed in the exhaust system preventing thermal damage to the constituent parts of the exhaust system during high load engine operation.

What is claimed is:

1. A secondary air supply device for supplying secondary air into the exhaust system of an internal combustion engine provided with a carburetor having a throttle valve rotatably disposed within the air-fuel mixture inducting passage thereof and a venturi portion located upstream of the throttle valve, said secondary air supply device comprising:

a pressurized secondary air supply conduit connecting an air source and the exhaust system for supplying secondary air from the air source into the exhaust system, said secondary air supply conduit having an orifice therein;

a vent conduit branched off from said secondary air supply conduit upstream of said orifice;

a vacuum operated valve operatively disposed in said vent conduit and operative in response to the intake manifold vacuum downstream of the throttle valve to vent an excessive secondary air fed into said secondary air supply conduit; and control means for controlling the intake manifold vacuum applied to said vacuum operated valve by the cooperation of the venturi vacuum generated at the venturi of the carburetor and the pressure differential between upstream and downstream sides of said orifice in said secondary air supply conduit in order to accurately control the amount of the secondary air supplied to the exhaust system in response to the amount of the intake air of the engine, said control means including a first pressure responsive diaphragm which is responsive to the venturi vacuum, a second pressure responsive diaphragm fixedly connected through a connecting member to said first pressure responsive diaphragm and responsive to the pressure differential between the upstream and downstream sides of said orifice in said secondary air supply conduit for moving said first pressure responsive diaphragm in response to the pressure differential acting on the second pressure responsive diaphragm, and valve means for controlling the intake manifold vacuum applied to said vacuum operated valve in response to the movement of said first and second pressure responsive diaphragms.

2. A secondary air supply device as claimed in claim 1, further comprising a vent conduit which is branched off from said secondary air conduit upstream of said orifice.

3. A secondary air supply device as claimed in claim 2, in which said vacuum operated valve includes a valve seat formed inside of said vent conduit and having an opening for venting the secondary air therethrough, a movable valve head seatable on said valve seat, a diaphragm member fixedly connected to said valve head and defining with a casing a vacuum chamber which communicates through a first pipe with a portion downstream of the throttle valve of the carburetor, and a spring disposed within the vacuum chamber for urging the diaphragm member in the direction to cause the valve head to open the valve, said spring being arranged to contract to cause said valve head to seat when the intake manifold vacuum is applied on the diaphragm member.

4. A secondary air supply device as claimed in claim 3, in which said valve means of said control means includes a valve member fixedly connected through a connecting member to said first pressure responsive diaphragm, and a second pipe branched off from the first pipe and having an open end which is closeable by said valve member.

5. A secondary air supply device as claimed in claim 4, in which said control means further includes a vacuum chamber communicating through a third pipe with the venturi portion of the carburetor, an atmospheric chamber communicating with the atmosphere, said vacuum chamber and said atmospheric chamber being on opposite sides of said first pressure responsive diaphragm, a first pressure chamber communicating with the upstream side of the orifice, and a second pressure chamber communicating with the downstream side of the orifice, said first and second pressure chambers being on opposite sides of said second pressure responsive diaphragm.

6. A secondary air supply device as claimed in claim 1, in which said first pressure responsive diaphragm is larger in effective area than said second pressure responsive diaphragm.

7. A secondary air supply device as claimed in claim 5, in which said control means further includes a spring disposed within the atmospheric chamber to urge the valve member of said control means in the direction to close the open end of the second pipe.

8. A secondary air supply device as claimed in claim 5, in which said control means further includes a first small diaphragm defining the vacuum chamber in a casing with the first pressure responsive diaphragm, the valve member being secured to the first small diaphragm, and a second small diaphragm disposed between the atmospheric chamber and the first pressure chamber, said first pressure responsive diaphragm being fixedly connected through said second small diaphragm to said second pressure responsive diaphragm, said first and second small diaphragms being smaller in effective areas than the second pressure responsive diaphragm.

9. A secondary air supply device as claimed in claim 5, further comprising means for decreasing the amount of the secondary air supplied into the exhaust system regardless of the amount of the exhaust gases during high engine speed and low engine load operation.

10. A secondary air supply device as claimed in claim 9, in which the secondary air amount decreasing means includes a third pressure responsive diaphragm fixedly connected to said second pressure responsive diaphragm and defining in a casing the second pressure chamber with said second pressure responsive diaphragm, said third pressure responsive diaphragm being smaller in effective area than said second pressure responsive diaphragm and defining with a casing a vacuum chamber opposite to the second pressure chamber with respect to said third pressure responsive diaphragm, and means for defining a hole open to the air-fuel mixture induction passage downstream of the venturi portion, said hole being located above the edge of the throttle valve when it is fully closed, and communicating with the vacuum chamber having said third pressure responsive diaphragm to apply the vacuum generated adjacent the hole to said third vacuum responsive diaphragm during high engine speed and low engine load operation.

11. A secondary air supply device as claimed in claim 2, in which said vacuum operated valve includes a valve seat formed inside of said vent conduit for venting the secondary air therethrough, a movable valve head seatable on said valve seat, a diaphragm member fixedly connected to said valve head of a vacuum chamber which communicates through a first pipe with a portion downstream of the throttle valve of the carburetor, and a spring disposed within the vacuum chamber urging the diaphragm member in the direction to cause the valve head to seat, said spring being arranged to close the valve when the intake manifold vacuum is not applied to the diaphragm member.

12. A secondary air supply device as claimed in claim 11, in which said first pressure responsive diaphragm is larger in effective area than said second pressure responsive diaphragm.

13. A secondary air supply device as claimed in claim 11, in which said control means further includes a second pipe branched off from the first pipe and having an open end which is adjacent said valve member, a vacuum chamber communicating through a third pipe with the venturi portion of the carburetor, an atmospheric chamber communicating with the atmosphere, said vacuum chamber and said atmospheric chamber being on opposite sides of said first pressure responsive diaphragm, a first pressure chamber communicating with the upstream side of the orifice, and a second pressure chamber communicating with the downstream side of the orifice, said first and second pressure chambers being on opposite sides of said second pressure responsive diaphragm.

14. A secondary air supply device as claimed in claim 13, in which said control means further includes a spring disposed within the atmospheric chamber for urging said first pressure responsive diaphragm in the direction to cause the valve member to open the open end of the branched off pipe.

15. A secondary air supply device as claimed in claim 13, in which said control means further includes a first small diaphragm which forms the atmospheric chamber with said first pressure responsive diaphragm, said valve member being secured to said first small diaphragm, and a second small diaphragm disposed between the vacuum chamber and the first pressure chamber, said first and second pressure responsive diaphragms being fixedly connected to each other through said second small diaphragms, said first and second small diaphragms being smaller in effective area than said first pressure responsive diaphragm.

16. A secondary air supply device as claimed in claim 13, further comprising means for decreasing the amount of the secondary air supplied into the exhaust system regardless of the amount of the exhaust gases during high engine speed and low engine load operation.

17. A secondary air supply device as claimed in claim 16, in which the secondary air amount decreasing means includes a pipe connecting to a pipe through which the atmospheric chamber communicates with the atmosphere, and means for defining a hole open to the air-fuel mixture induction passage of the carburetor, the hole being located above the edge of the throttle valve when it is fully closed, and communicates with said pipe connecting to the pipe through which the atmospheric chamber communicates with the atmosphere.

18. A secondary air supply device as claimed in claim 1, said air source is an air pump the air discharge amount of which increases with engine speed.

* * * * *